US006080091A

United States Patent [19]

Habing et al.

[11] Patent Number: 6,080,091

[45] Date of Patent: Jun. 27, 2000

[54] EXERCISE MACHINE PRESS ARM

[75] Inventors: Theodore G. Habing, Santa Ana; Douglas J. Habing, Long Bch.; Yong S. Chu, Glendale, all of Calif.

[73] Assignee: Precor Incorporated, Bothell, Wash.

[21] Appl. No.: 09/271,689

[22] Filed: Mar. 18, 1999

Related U.S. Application Data

[63] Continuation of application No. 08/895,517, Jul. 16, 1997.

[51] Int. Cl.[7] ..... A63B 23/12

[52] U.S. Cl. ..... 482/137; 482/100; 482/139

[58] Field of Search ..... 482/97, 100, 130, 482/137–139

[56] References Cited

U.S. PATENT DOCUMENTS

| | | |
|---|---|---|
| 4,949,951 | 8/1990 | Deola . |
| 5,236,406 | 8/1993 | Webber . |
| 5,580,341 | 12/1996 | Simonson . |
| 5,643,152 | 7/1997 | Simonson . |
| 5,683,334 | 11/1997 | Webber . |

OTHER PUBLICATIONS

Body Masters Sports Industry Inc. Brochure for Vertical Pectoral Contractor and Rear Deltoid Machine (CH 504).
SPF 2000 Freedom Chest Press, undated brochure.

*Primary Examiner*—John Mulcahy
*Attorney, Agent, or Firm*—Blakely, Sokoloff, Taylor & Zafman LLP

[57] ABSTRACT

An improved press arm allows an operator to perform either a traditional straight chest press exercise or to incorporate "butterfly" motion during the performance of the chest press exercise. A main arm is pivotally coupled to the frame of the exercise machine at a main pivot in the same manner as conventional press arms. The main arm includes a cross-beam to which a pair of handle arms are pivotally coupled at secondary pivots. The axes of the secondary pivots are orthogonal to the axis of the main pivot and are inclined with respect to vertical when the press arm is in a rest position. This inclination causes the handle arms to assume a natural rest position under the influence of gravity. The rest positions of the handle arms place the press arm handles at a comfortable starting position for performance of a press exercise. Stops to limit the inward or outward travel of the handle arms are not necessary. A source of exercise resistance resists both forward motion of the press arm assembly and inward motion of the handle arms.

12 Claims, 2 Drawing Sheets

EXERCISE MACHINE PRESS ARM

This is a continuation of co-pending application Ser. No. 08/895,517 filed Jul. 16, 1997.

BACKGROUND OF THE INVENTION

1. Field of the Invention

This invention relates generally to the field of physical exercise equipment and, particularly, to a press arm for performing upper body exercises.

2. Prior Art

The bench press has long been a popular exercise for developing the muscles of the upper body. This exercise is traditionally performed in a supine position on a bench using a barbell. Within the last few decades, exercise machines have been developed with pivoting press arms coupled to a stack of weights that allow the operator to perform exercises from a seated position. Typically, the seat of the machine is adjustable so that shoulder press, incline press, chest press, and decline press exercises can all be performed using the same press arm.

A conventional press arm is pivotally attached to the frame of an exercise machine and has a pair of fixed handles for use by the operator. The operator pushes the press arm directly away from the torso during performance of the exercise. However, it has been found that a more thorough exercise can be achieved if the operator is able to move his or her arms inwardly (in what is commonly referred to as a "butterfly" or "fly" motion) as the press arm is pushed outwardly. Exercise machines have been developed to afford this additional component of movement. For example, U.S. Pat. No. 5,437,589 discloses such a machine for performing shoulder, incline, chest and/or decline press exercises. While the apparatus disclosed in the aforementioned patent provides a near optimal upper body exercise, the apparatus does not lend itself to incorporation in a relatively low cost multi-station exercise machine.

Some exercise machines have employed press arms with secondary pivots to provide the additional freedom of movement necessary for the operator to move his or her arms inwardly as the press arm is pushed outwardly. An example of such a device is shown in U.S. Pat. No. 4,949,951 issued to Deola. This patent discloses an exercise machine with a press arm having forward extension members that are coupled to the press arm with universal joints. The extension members permit the user of the machine to perform a "dumbbell fly" movement. Owing to the universal joint between the extension members and the press arm, the extension members will naturally fall towards the floor if let go. This is inconvenient for the user of the apparatus and, further, requires that the user exert an upward force on the extension members simply to maintain them in position for performing an exercise.

Another example of a prior art exercise machine is shown in U.S. Pat. No. 5,580,341 issued to Simonson. This machine for performing a shoulder press exercise has a pair of independent arms coupled to the machine by a primary hinge with a horizontal axis and respective secondary hinges. The design of the machine permits inward movement of the arms, but does not allow a true fly movement. The axes of the secondary hinges are preferably oriented at symmetric acute angles with respect to the primary hinge. This arrangement of the primary and secondary hinges operates to divide the exercise resistance into a longitudinal component and a lateral component. The lateral motion of the arms in Simonson's machine Is limited outwardly by an interconnecting strap and inwardly by respective stops. These stops preclude anything more than a straight press or inward press movement during performance of a press exercise. Since outward movement of the arms is prevented by the stops, a full fly movement cannot be performed.

Still another example of a prior art machine is the Freedom Chest Press manufactured by Pacific Fitness Corporation. In a manner somewhat analogous to Deola's exercise machine, the Freedom Chest Press has a pair of extension members pivotally coupled to the main press arm. The extension members pivot about respective secondary axes that are perpendicular to the main pivot axis of the press arm. Outward movement of the extension members is limited by respective stops, and thus, as with Simonson's machine, a full fly movement cannot be performed.

Each of these prior art devices has certain disadvantages which are overcome by the apparatus of the present invention. One of the objects of the present invention is to provide an exercise machine offering combined press and fly movements without the use of stops to limit the amount of fly movement available to the user. Another object of the present invention is to provide exercise arms for performing the combined press and fly movement exercises that have a gravity-induced natural rest position corresponding to the starting position for such exercises.

SUMMARY OF THE INVENTION

The present invention provides an improved press arm with which an operator can perform either a traditional straight chest press exercise or may incorporate "butterfly" motion during the performance of the chest press exercise. The press arm has three principal components. A main arm is pivotally coupled to the frame of the exercise machine at a main pivot in the same manner as conventional press arms. The main arm includes a cross-beam to which a pair of handle arms are pivotally coupled at secondary pivots. The axes of the secondary pivots are orthogonal to the axis of the main pivot and are inclined with respect to vertical when the press arm is in a rest position. This inclination causes the handle arms to assume a natural rest position under the influence of gravity. The rest positions of the handle arms place the press arm handles at a comfortable starting position for performance of a press exercise. Stops to limit the inward or outward travel of the handle arms are not necessary.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
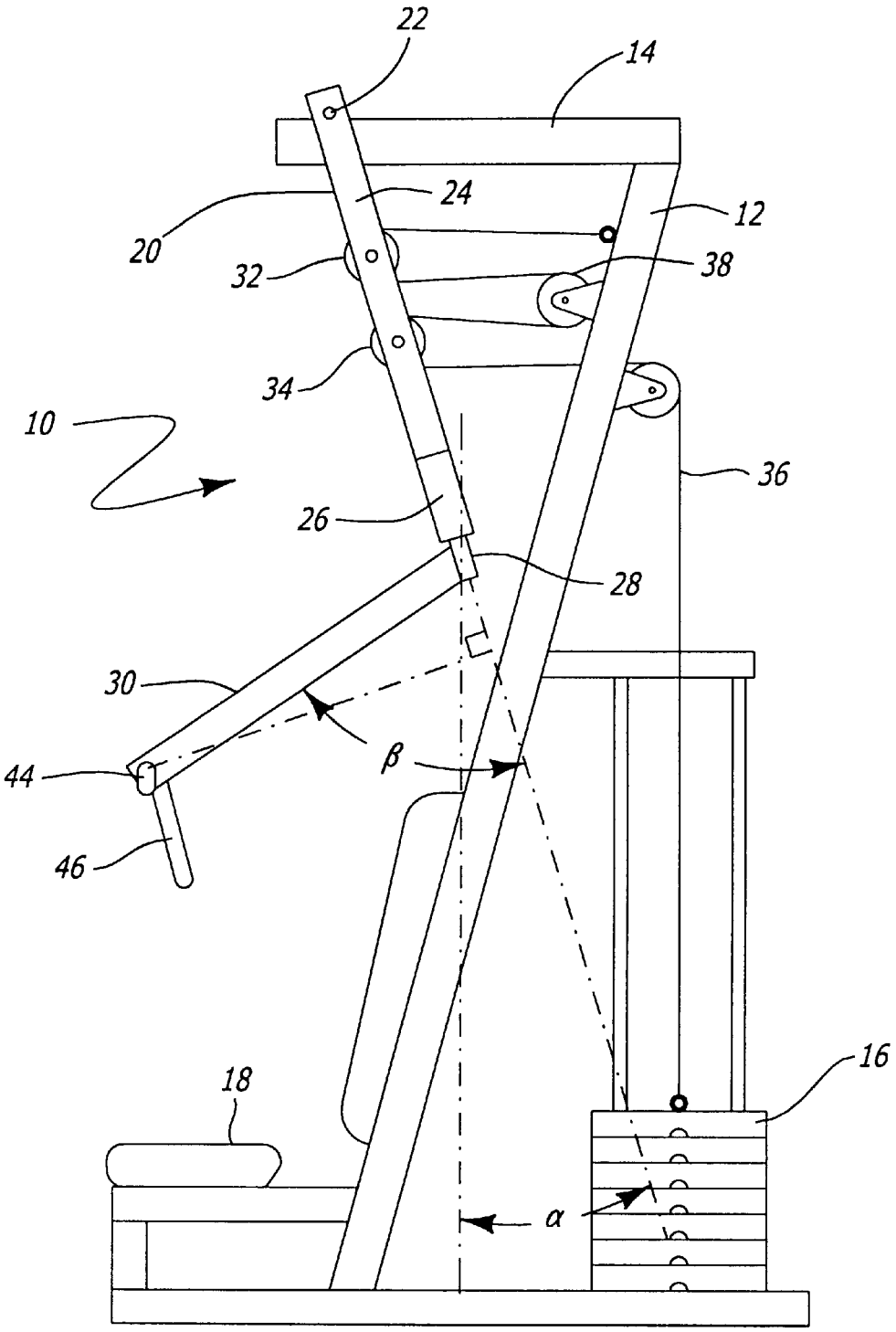
FIG. 1 is a partial side elevational view of an exercise machine incorporating the press arm of the present invention.

With reference to FIG. 1, exercise machine 10 is a special purpose exercise machine for performing press, fly and combination press/fly exercises. Exercise resistance may be provided by a selectable weight stack 16. Other sources of exercise resistance may also be utilized, including individual weight plates, hydraulic, pneumatic, electromagnetic or friction mechanisms, or even the operator's own body weight. Although the present invention is illustrated as an exercise machine dedicated only to press and fly exercises, it is to be understood that the invention may also be embodied as part of a multi-station exercise machine in which a variety of individual exercise stations may be included in addition to the press arm as is well known to practitioners in the art.

Exercise machine 10 includes an upright frame member 12 and a top beam member 14. A seat 18 for the operator of the exercise machine is attached to upright frame member 12. Press arm 20 is coupled to top beam member 14 at main pivot 22. Main arm members 24 are attached to transverse cross member 26. A secondary pivot 28 is attached at each end of transverse cross member 26. Handle arms 30 are pivotally attached to cross member 26 at pivots 28. Pulleys 32 and 34 are rotatably mounted between main arm members 24. Cable 36 is routed around pulleys 32 and 34 and also around pulley 38, which is rotatably mounted on upright frame member 12. One end of cable 36 communicates with the weight stack 16 or other suitable source of exercise resistance. The opposite end of cable 36 is attached to frame member 12. Alternatively, cable 36 could continue on to communicate with additional exercise stations in a multi-station embodiment. When press arm 20 is in use, forward motion of the press arm away from frame upright member 12 lengthens the path of cable 36 and thereby lifts the selected weights of the weight stack.

Figure 2:
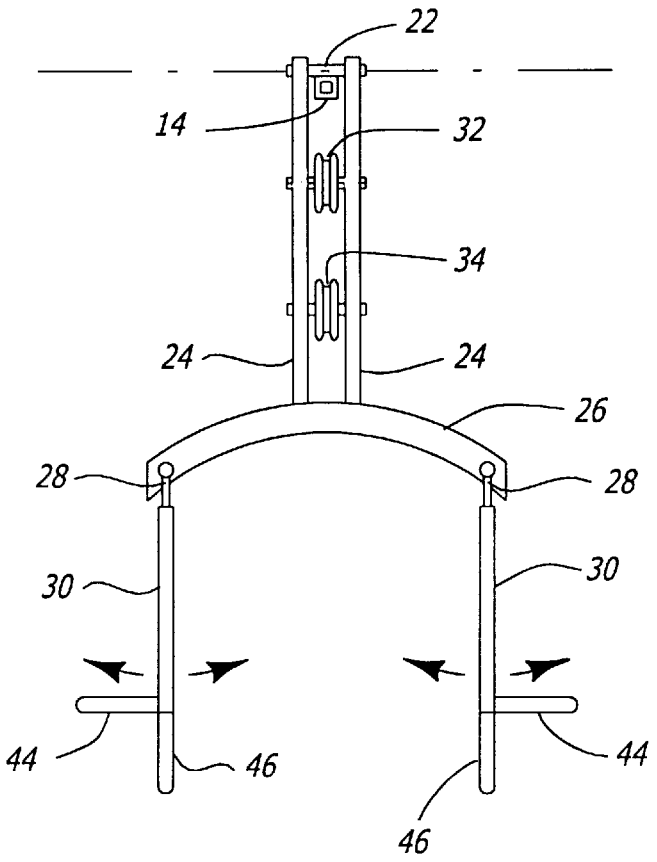
FIG. 2 is a partial front elevational view of the exercise machine of FIG. 1.

As shown in FIG. 1, press arm 20 is in its rest position. The axes of secondary pivots 28 are inclined from vertical by an angle a. As a result of the inclination of the secondary pivot axes, handle arms 30 will assume a lateral rest position under the influence of gravity. As shown in FIG. 2, the natural rest position of handle arms 30 in the lateral direction is generally straight down from pivots 28.

As handle arms 30 pivot about the respective secondary pivots 28, each point along handle arm 30 traces a circular path about the axis of rotation. The axes of the two secondary pivots are parallel to one another, and thus, the circular paths of corresponding points on the two handle arms 30 lie in a common plane. The axes of secondary pivots 28 are orthogonal to the axis of main pivot 22.

Still referring to FIG. 2, each of handle arms 30 has a generally horizontal hand grip 44 and a generally vertical hand grip 46. As the operator performs a press exercise, hand grips 44 or 46 may be pushed straight out as in a traditional chest press exercise. Alternatively, the operator may also pull inwardly with a butterfly motion, causing handle arms 30 to rotate about secondary pivots 28. Resistance to such inward movement of the handle arms is provided by the weight stack or other source of exercise resistance since an incremental inward movement of the handle arms causes a corresponding incremental forward movement of main arm members 24 (assuming that the operator does not relax the forward pressure on the press arm and maintains the longitudinal position of the hand grips 44 or 46).

Referring again to FIG. 1, handle arm 30 is inclined with respect to the secondary pivot axis by an angle β. The effective length of the handle arm is equal to (sinβ×actual length of handle arm). A shorter effective length of the handle arms produces greater resistance to inward movement of the arms. The same effect can be achieved by increasing the lateral distance between pivots 28. The exercise "feel" sensed by the operator depends on several factors, including the effective length of the handle arms, the actual length of the handle arms and the lateral distance between the secondary pivots. Angling the handle arms with respect to the axes of the secondary pivots assists in achieving a natural gravity rest position for the handle arms and yields a more compact design for the press arm than would otherwise be possible if the handle arms were designed to be perpendicular to the axes of the secondary pivots.

The lateral distance between pivots 28 is slightly wider than the lateral distance between the shoulder joints of a typical user of exercise machine 10. Also, as press arm 20 is pushed forward, the axes of pivots 28 will be near vertical at the end of the exercise stroke. The combination of these two design features results in a nearly ideal fly motion for the user of the machine.

Figure 3:
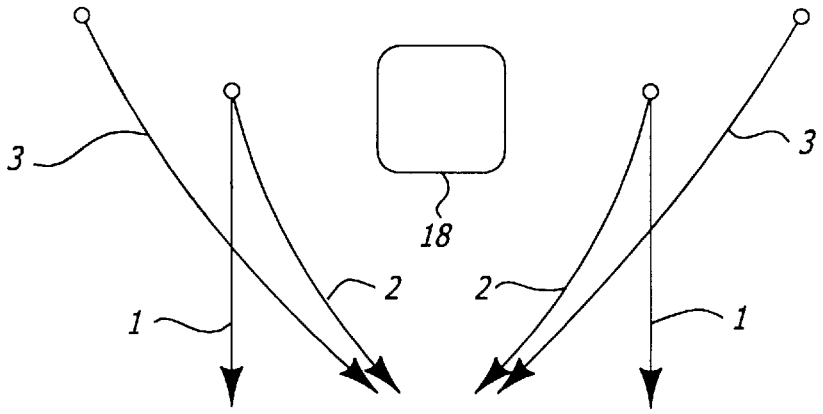
FIG. 3 illustrates the paths of motion for various exercises that may be performed using the exercise machine of FIG. 1.

As mentioned above, the operator of exercise machine 10 can select the manner in which a press exercise is performed. Some of the exercise movements available to the operator are illustrated diagrammatically in FIG. 3. This figure represents an overhead view of exercise machine 10 showing the combination of straight press and press/fly combination movements that are available. Starting from the natural rest position of press arm 20, arrows 1 illustrate a straight press exercise. Arrows 2 illustrate a press exercise with inward fly movement. Finally, arrows 3 illustrate a full butterfly exercise in which the operator begins with handle arms 30 spread outwardly and then pulls inwardly and forwardly with elbows locked.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus comprising:

a frame;

a press arm pivotally coupled to the frame, said press arm having a main arm member depending from a main pivot on the frame and a pair of secondary arms coupled to the main arm member at respective secondary pivots, wherein each of the secondary arms pivots without constraint both inwardly and outwardly about a respective one of the secondary pivots from a respective at-rest position, but each is constrained to move within a respective arcuate path that is fixed relative to the main arm member;

a source of exercise resistance;

means for coupling said source of exercise resistance to said press arm.

2. The exercise apparatus of claim 1 wherein said source of exercise resistance comprises a weight.

3. The exercise apparatus of claim 2 wherein said means for coupling said source of exercise resistance to said press arm comprises a cable coupled to the weight.

4. The exercise apparatus of claim 3 wherein said means for coupling said source of exercise resistance to said press arm further comprises at least one pulley rotatably mounted on the main arm member.

5. The exercise apparatus of claim 1 wherein the main arm member includes a transverse cross member.

6. The exercise apparatus of claim 5 wherein the secondary pivots are disposed at opposite ends of said transverse cross member.

7. The exercise apparatus of claim 1 wherein each of the main and secondary pivots has a respective pivot axis and wherein the pivot axes of the secondary pivots are parallel to each other and orthogonal to the pivot axis of the main pivot.

8. The exercise apparatus of claim 1 wherein each of the secondary arms extends at an oblique angle with respect to the respective secondary pivot axis.

9. A press arm for an exercise machine comprising:

a main arm member having a main pivot and a pair of laterally spaced apart secondary pivots orthogonal with respect to the main pivot, said secondary pivots parallel to one another and inclined with respect to vertical;

a pair of secondary arms coupled to the main arm member at respective ones of the secondary pivots;

wherein each of the secondary arms pivots without constraint both inwardly and outwardly about a respective one of the secondary pivots from a respective at-rest position pendulous below the main arm member and wherein each of the secondary arms is constrained to move within a respective arcuate path that is fixed relative to the main arm member.

10. The press arm of claim 9 wherein the main arm member includes a transverse cross member.

11. The press arm of claim 10 wherein the secondary pivots are disposed at opposite ends of said transverse cross member.

12. The press arm of claim 9 wherein each of the secondary arms extends at an oblique angle with respect to the respective secondary pivot axis.

* * * * *

UNITED STATES PATENT AND TRADEMARK OFFICE

CERTIFICATE OF CORRECTION

PATENT NO. : 6,080,091
DATED : June 27, 2000
INVENTOR(S) : Habing et al.

It is certified that error appears in the above-identified patent and that said Letters Patent is hereby corrected as shown below:

Column 1,
Line 67, delete "machine Is limited" and insert -- machine is limited --.

Column 3,
Line 38, delete "by an angle a" and insert -- by an angle α --.

Column 5,
Line 9, delete "The exercise apparatus of claim 1" and insert -- The exercise apparatus of claim 7 --.

Signed and Sealed this

Fifth Day of February, 2002

*Attest:*

*Attesting Officer*

JAMES E. ROGAN
*Director of the United States Patent and Trademark Office*